US010494749B1

(12) United States Patent
Baughman

(10) Patent No.: US 10,494,749 B1
(45) Date of Patent: Dec. 3, 2019

(54) AGITATOR INSERT FOR WASHING MACHINES TO ENHANCE CLEANING

(71) Applicant: Jerald Baughman, Longwood, FL (US)

(72) Inventor: Jerald Baughman, Longwood, FL (US)

( * ) Notice: Subject to any disclaimer, the term of this patent is extended or adjusted under 35 U.S.C. 154(b) by 78 days.

(21) Appl. No.: 15/622,705

(22) Filed: Jun. 14, 2017

Related U.S. Application Data

(60) Provisional application No. 62/349,786, filed on Jun. 14, 2016.

(51) Int. Cl.
*D06F 39/02* (2006.01)
*D06F 35/00* (2006.01)

(52) U.S. Cl.
CPC ..... *D06F 35/00* (2013.01)

(58) Field of Classification Search
CPC ..... D06F 39/02
See application file for complete search history.

(56) References Cited

U.S. PATENT DOCUMENTS

| | | | | |
|---|---|---|---|---|
| 4,129,018 | A | 12/1978 | Platt | |
| D326,937 | S | 6/1992 | Miyahara | |
| D406,679 | S | 3/1999 | Depalma | |
| 5,950,460 | A | 9/1999 | Oh | |
| D583,519 | S | 12/2008 | Roberts | |
| D604,466 | S | 11/2009 | Gaa et al. | |
| D646,447 | S | 10/2011 | Lozano | |
| D646,448 | S | 10/2011 | Cheng | |
| D746,007 | S | 12/2015 | Oh | |
| 2010/0281928 | A1 | 11/2010 | Martin | |
| 2015/0299933 | A1 | 10/2015 | Oh | |
| 2016/0000175 | A1* | 1/2016 | Williams, Sr. | A43B 3/16 36/127 |

OTHER PUBLICATIONS

Techtongda 4pc Laundry Wash Dryer Balls Laundry Drying Fabric Softener Reusable Laundry Ball Washing Ball, retrieved from https://www.amazon.com/dp/B06XYY1J6X?psc=1, retrieved on May, 23 2017, 5 pages.

* cited by examiner

*Primary Examiner* — Jason Y Ko
(74) *Attorney, Agent, or Firm* — Brian S. Steinberger; Hilary F. Steinberger; Law Offices of Brian S. Steinberger, P.A.

(57) ABSTRACT

Devices, apparatus, systems and methods for enhancing cleaning operations in washing machines by providing one-piece agitator inserts in washing machines that agitates laundry to enhance cleaning during the washing and/or rinse cycles in the washing machines. The agitators do not release any chemicals and can be reused with different laundry loads. A preferred embodiment of an agitator can include a cross pattern of prongs, each having bulbous ends, and a center post extending upward and downward from an axis of the cross pattern.

11 Claims, 7 Drawing Sheets

AGITATOR INSERT FOR WASHING MACHINES TO ENHANCE CLEANING

CROSS REFERENCE TO RELATED APPLICATIONS

This application claims the benefit of priority to U.S. Provisional Application Ser. No. 62/349,786 Jun. 14, 2016, the entire disclosure of which is incorporated by reference in its' entirety.

FIELD OF INVENTION

This invention relates to washing machines, and in particular to devices, apparatus, systems and methods for enhancing cleaning operations in washing machines by providing molded agitator inserts that do not contain any detergents and are not ball, oval or cylindrical shaped for being individually inserted into washing machines that agitates laundry to enhance cleaning during the washing and/or rinse cycles in the washing machines.

BACKGROUND AND PRIOR ART

Washing machines are well known for cleaning laundry such as but not limited to clothing, towels, sheets, and the like. The washing machines have at least three cycles which are described below.

For the was. cycle, the machine is filled to a certain water level, and chemicals such as cleaning solutions, powders, etc. are dispensed into the basket filled with the laundry load, and the load is agitated for a certain amount of time, followed by draining the water.

Washing machines typically use a built in fixed vertically oriented agitator generally with vanes to mix laundry detergent during a wash. See for example, U.S. Pat. No. 4,129,018 to Platt and U.S. Pat. No. 5,950,460 to Oh.

For the rinse cycle, the machine is filled to a certain water level, the load is again agitated for a certain amount of time and water is drained.

The third cycle can be a spin cycle, where the basket is rapidly rotated for a certain amount of time with the drain open so most remaining water is removed by the centrifugal force.

Off the shelf products for use with washing machines have centered upon cleaning solutions and powders and fabric softeners and the like, which release some chemical into the laundry load.

Over the years various types of separate insert devices have been proposed, such as balls, ovals, and cylindrical disc shapes, which have chemicals inside that are released.

See for example, U.S. Des. Pat. No. 326,937 to Miyahara; U.S. Des. Pat. No. 406,679 to DePalma; U.S. Des. Pat. No. D583,519 to Roberts; U.S. Des. Pat. No. D604,466 to Gaa et al.; U.S. Des. Pat. No. D646,448 to Cheng; and U.S. Des. Pat. No. D746,007 to Oh. Also, see U.S. Published Patent Applications: 2010/0281928 to Martin and 2015/0299933 to Oh.

The inventor is not aware of any non-chemical release and non-ball and non-oval and non-cylindrical disc shaped reusable devices that can be placed in the basket to enhance either or both the wash and rinse cycles.

Thus, the need exists for solutions to the above problems with the prior art.

SUMMARY OF THE INVENTION

A primary objective of the present invention is to provide devices, apparatus, systems and methods for enhancing cleaning operations in washing machines that agitates laundry to enhance cleaning during the washing and/or rinse cycles in the washing machines, with a reusable non-ball and non-oval and non-cylindrical shaped reusable device that does not release chemicals.

A secondary objective of the present invention is to provide devices, apparatus, systems and methods that provide non-chemical release inserts in washing machines that to enhance cleaning during the washing and/or rinse cycles in the washing machines.

A third objective of the present invention is to provide devices, apparatus, systems and methods that provided both non-chemical release inserts and extra agitators for washing machines that to enhance cleaning during the washing and/or rinse cycles in the washing machines.

Further objects and advantages of this invention will be apparent from the following detailed description of the presently preferred embodiments which are illustrated schematically in the accompanying drawings.

DESCRIPTION OF THE PREFERRED EMBODIMENTS

Before explaining the disclosed embodiments of the present invention in detail it is to be understood that the invention is not limited in its applications to the details of the particular arrangements shown since the invention is capable of other embodiments. Also, the terminology used herein is for the purpose of description and not of limitation.

In the Summary above and in the Detailed Description of Preferred Embodiments and in the accompanying drawings, reference is made to particular features (including method steps) of the invention. It is to be understood that the disclosure of the invention in this specification does not include all possible combinations of such particular features. For example, where a particular feature is disclosed in the context of a particular aspect or embodiment of the invention, that feature can also be used, to the extent possible, in combination with and/or in the context of other particular aspects and embodiments of the invention, and in the invention generally.

In this section, some embodiments of the invention will be described more fully with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will convey the scope of the invention to those skilled in the art. Like number refer to like elements throughout, and prime notation is used to indicate similar elements in alternative embodiments.

A list of the reference numbers used in the Figures will now be described.

Figure 1:
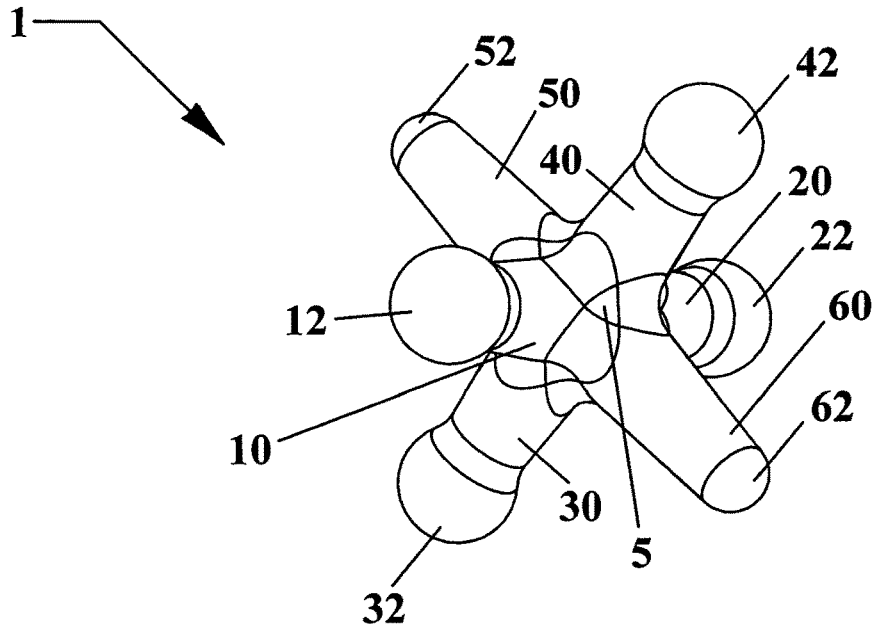
FIG. 1 is a front right perspective view of an agitator.
Figure 2:
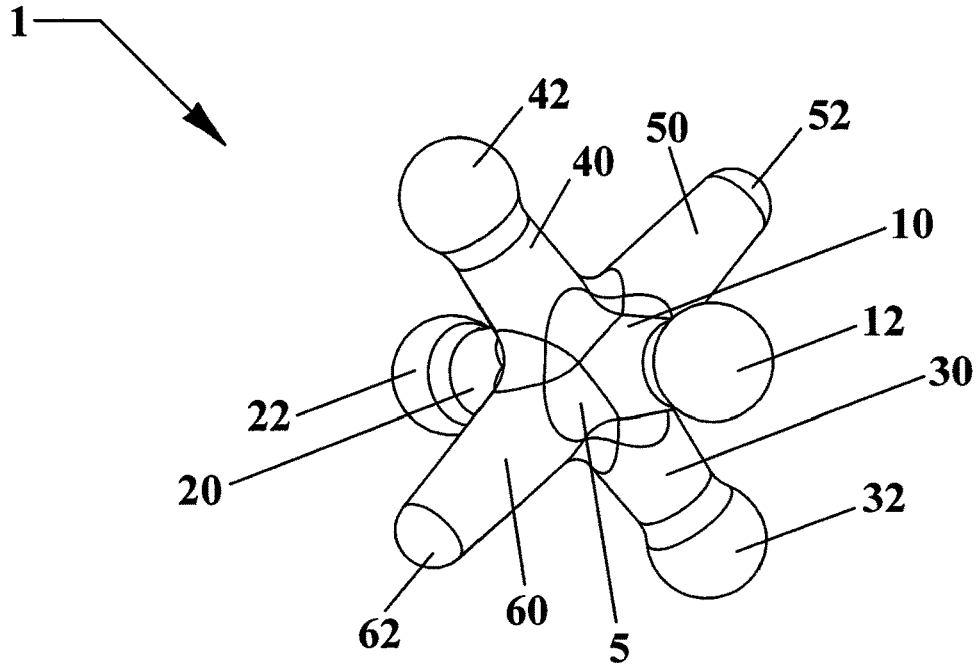
FIG. 2 is a front left perspective view of the agitator of FIG. 1.
Figure 3:
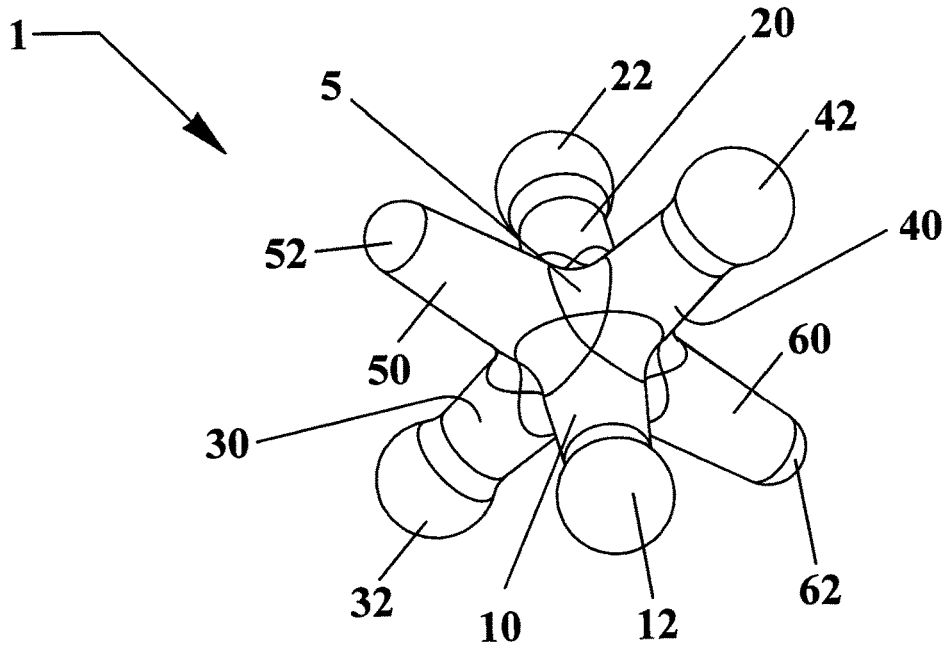
FIG. 3 is an upper front perspective view of the agitator of FIG. 1.
Figure 4:
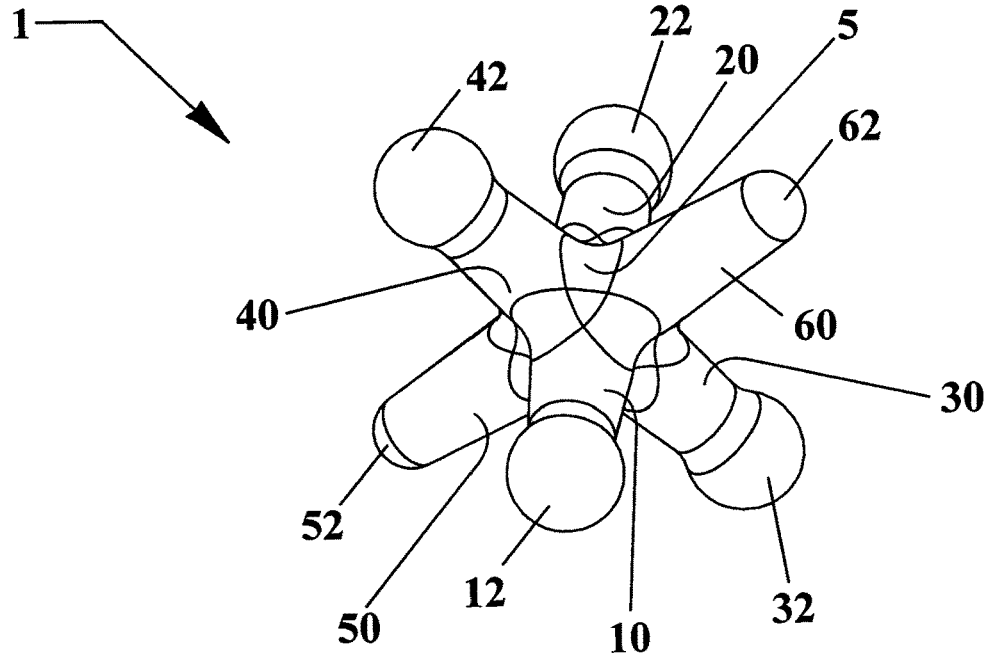
FIG. 4 is lower front perspective view of the agitator of FIG. 1.
Figure 5:
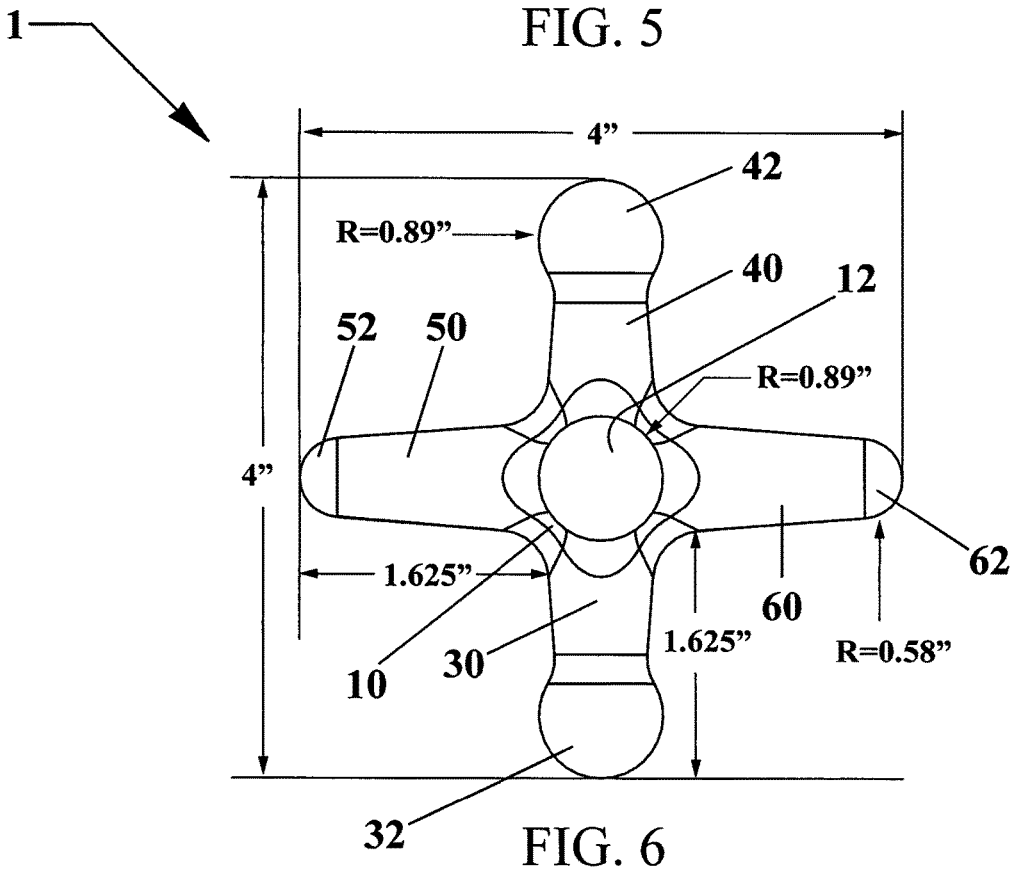
FIG. 5 is a front side view of the agitator of FIG. 1.
Figure 6:
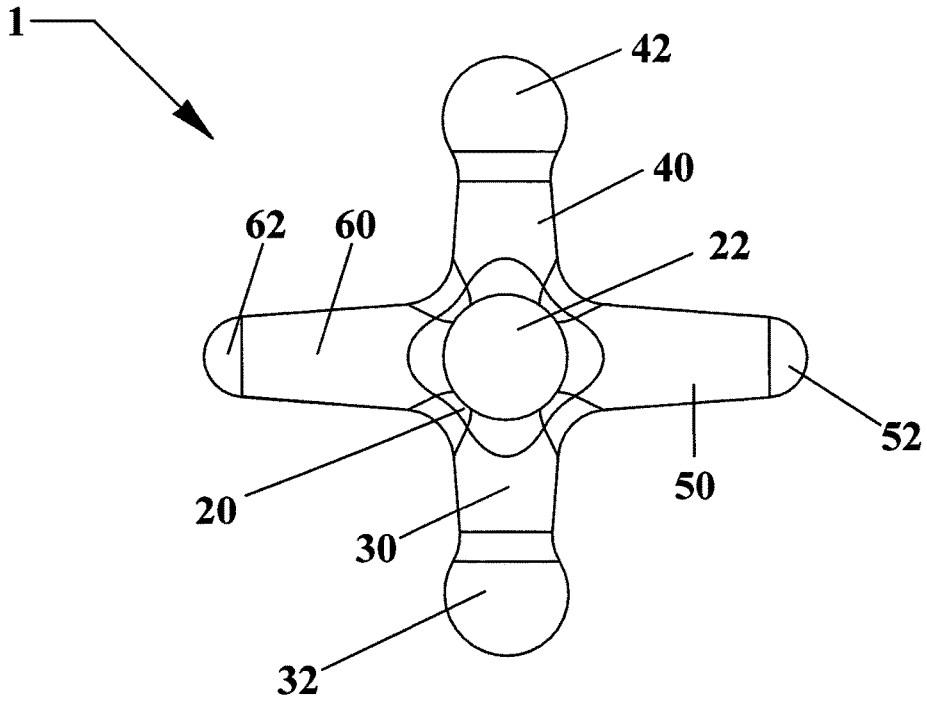
FIG. 6 is a rear side view of the agitator of FIG. 1.
Figure 7:
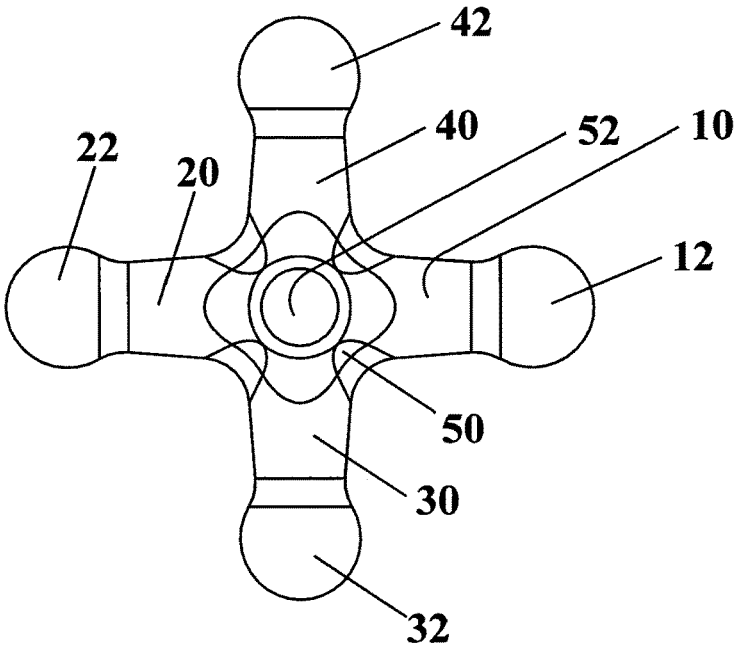
FIG. 7 is a left side view of the agitator of FIG. 1.
Figure 8:
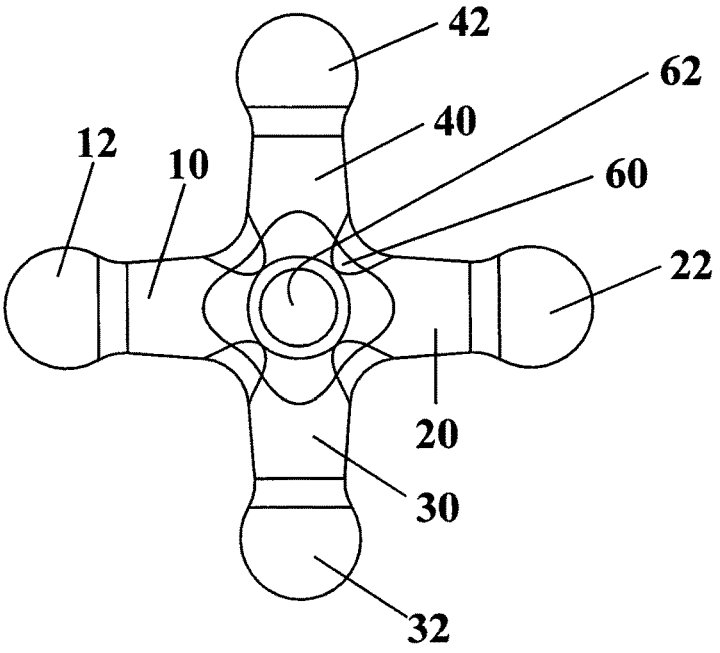
FIG. 8 is a right side view of the agitator of FIG. 1.
Figure 9:
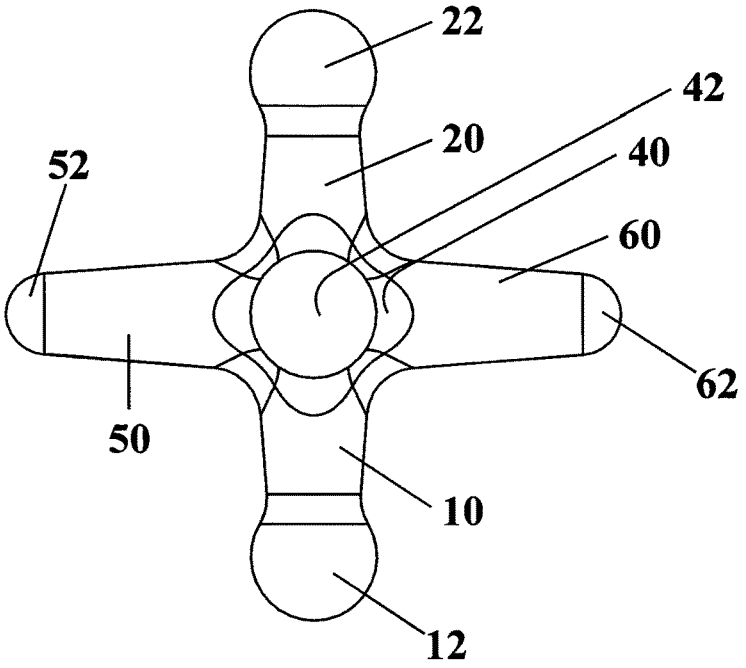
FIG. 9 is a top side view of the agitator of FIG. 1.
Figure 10:
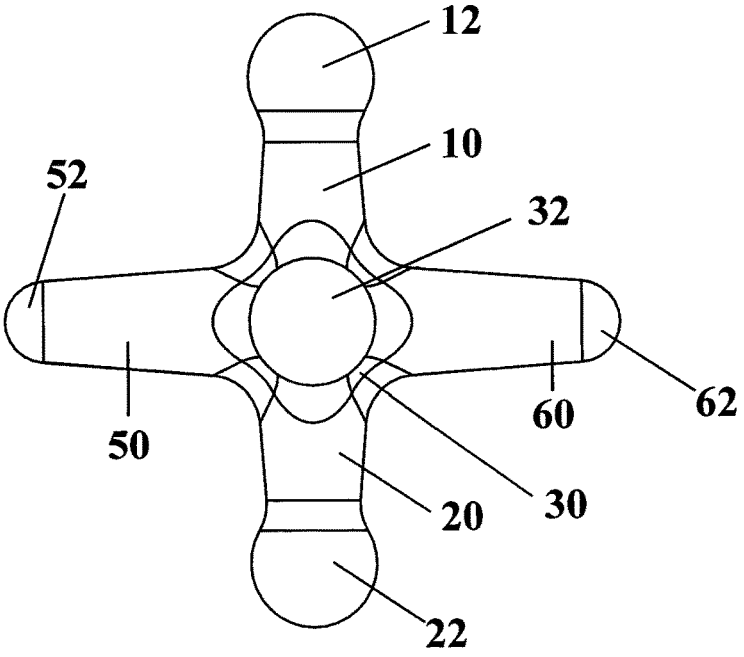
FIG. 10 is a bottom side view of the agitator of FIG. 1.

1 agitator
5 center axis
10 front leg/prong
12 front ball (bulbous shape) outer end
20 rear leg/prong
22 rear ball (bulbous) outer end
30 bottom leg/prong
32 bottom ball (bulbous) outer end
40 top leg/prong
42 top ball (bulbous) outer end
50 left post
52 left dome shape (blunt tip) outer end
60 right post
62 right dome shape (blunt tip) outer end
100 package of agitators
200 washing machine FIG. 1 is a front right perspective view of an agitator 10. FIG. 2 is a front left perspective view of the agitator 10 of FIG. 1. FIG. 3 is an upper front perspective view of the agitator 10 of FIG. 1. FIG. 4 is a lower front perspective view of the agitator 10 of FIG. 1. FIG. 5 is a front side view of the agitator 10 of FIG. 1. FIG. 6 is a rear side view of the agitator 10 of FIG. 1. FIG. 7 is a left side view of the agitator 10 of FIG. 1. FIG. 8 is a right side view of the agitator 10 of FIG. 1. FIG. 9 is a top side view of the agitator 10 of FIG. 1. FIG. 10 is a bottom side view of the agitator 10 of FIG. 1.

Referring to FIGS. 1-10, the agitator 1 can be formed from 100% silicon. Additionally, the agitators 1 can be solid and formed from materials, such as but not limited to injection molded plastics, ABS plastic, fiberglass, compositions thereof, and the like. The agitator 1 can be reused over time.

The agitator 1 can have a cross pattern of legs/prongs 10, 20, 30, 40 with either ball shaped (bulbous) ends 12, 22, 32, 42, and posts 50, 60 with dome shaped (tipped) outer ends 52, 62.

A preferred version of the agitators 1 can each have a cross pattern of a legs/prongs 10, 20, 30, 40 and posts 50, 60 each extending outward from a center axis 5. The legs/posts 10, 20 generally being in a straight line, and the legs/posts 30, 40 generally being in a straight line. The straight line formed from legs/posts 10, 20 being perpendicular to the straight line formed from legs/posts 30, 40.

Left and right posts 50, 60 can also be generally in a straight line and are perpendicular to both the straight lines formed from front and rear legs/posts 10, 20 and the straight line formed from top and bottom legs/posts 30, 40. Posts 50, 60 can have an enlarged base end adjacent to the center axis 5 with tapers down to the dome shaped (blunt tip) outer ends 52, 62.

An example of an agitator 1 can have a width between outer dome shaped (blunt tip) outer ends 52 and 62 of approximately 4 inches, a length between ball shaped (bulbous) outer ends 12, 22 of approximately 4 inches, and a length between ball shaped (bulbous) outer ends 32, 42 of approximately 4 inches.

Each of the posts/legs 10, 20, 30, 40 can have a length of approximately 1.625 inches between the center axis 5 and the ball shaped (bulbous) outer ends 12, 22, 32, 42. Each of the posts 50, 60 can have a length of approximately 1.625 between dome shaped (blunt tip) outer ends 52, 62 and center axis 5.

Each of the ball shaped (bulbous) outer ends 12, 22, 32, 42, can have a radius of approximately 0.89 inches, and each of the dome shaped (blunt tip) outer ends 52, 62 can have a radius of approximately 0.59 inches.

Figure 11:
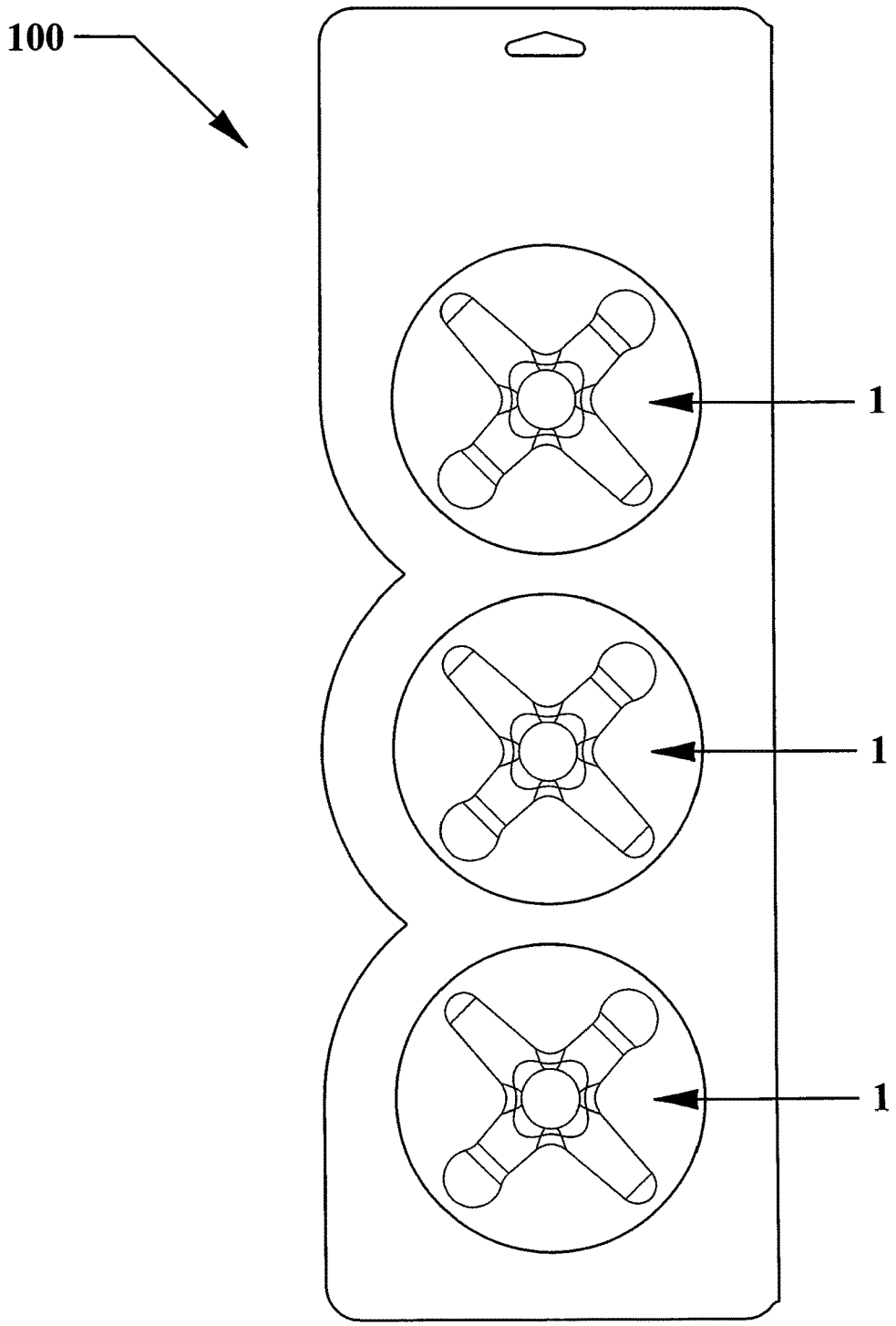
FIG. 11 is a view of a package of a plurality of the agitators of FIG. 1.

FIG. 11 is a view of a package 100 of a plurality of the agitators 1 of FIG. 1. A preferred package 100 can include three agitators 1 per package that can be shrink wrapped with the agitators 1 able to be seen through the package 100.

Figure 12:
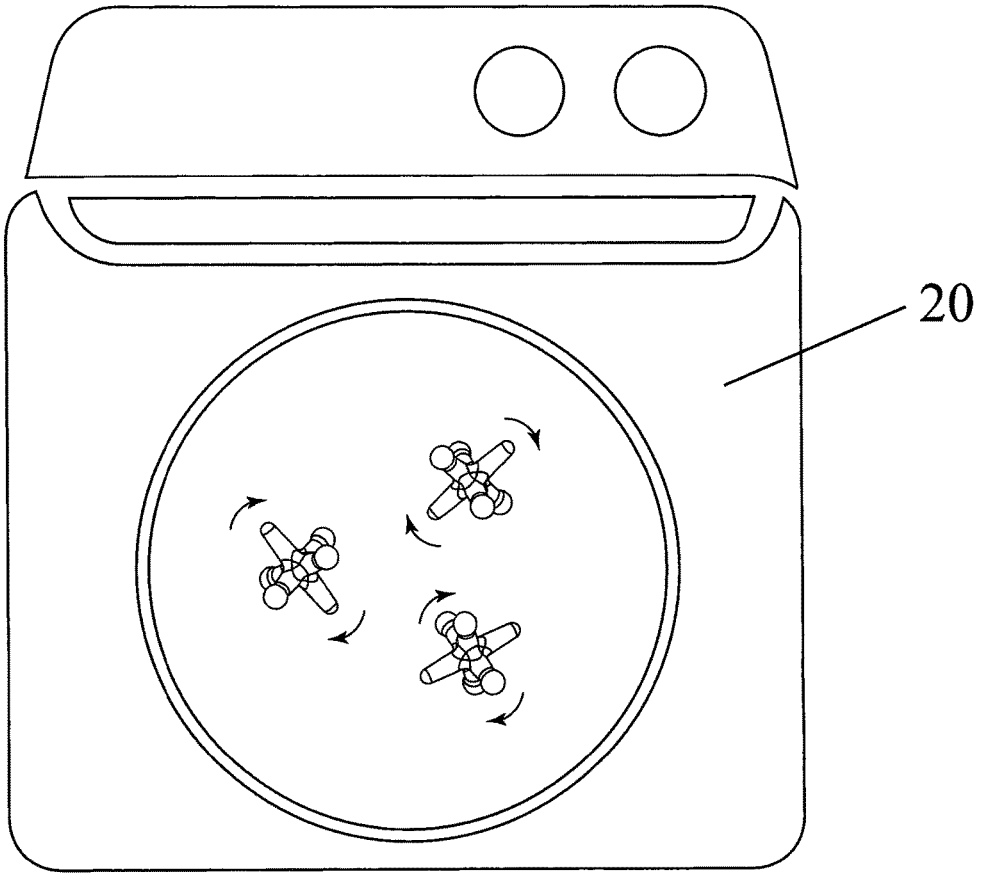
FIG. 12 shows a washing machine with the agitators of FIG. 1 mixing with clothes.

FIG. 12 shows a washing machine 200 with the agitators 1 of FIG. 1 mixing with clothes.

The agitators 1 (one, two, three or more) can also be tossed (and thrown) into the washing machine basket in a top loading washing machine and be used during the cleaning cycle. The agitators 1 can activate the cleaning action by further breaking up detergent and cleaning materials, as well as push those materials into the laundry in the washing machine baskets to achieve a deeper cleaning action.

The agitators 1 can also be tossed (and thrown) into the washing machine basket with the laundry and be used during the rinse cycle.

Alternatively, the agitators 1 can be used during both the cleaning and the rinse cycles with the laundry in the washing machine baskets.

The agitators can. work in all types of washing machines (both front loading and top loading), and be reusable with different loads of laundry.

There are no chemicals released from the agitators 1, and the agitators do not change shape over time and use. The agitators 1 do not have sharp edges and will not damage the laundry by puncturing or ripping the laundry during use in the washing machine cycles.

Generally, the agitators can work while the washing machine tumbles or agitates during normal cycles (cleaning and/or rinse cycles), and are generally removed when laundry is moved to a dryer.

Other shapes for the agitators can also be used. The agitators, can come in different sizes and shapes. More than three or less than three agitators can be used during the cleaning and/or rinse cycles.

The agitators 1 can work by tumbling around in the washing machine acting as an extra agitator, and can help manipulate dirt from deep in the fibers of clothes during the laundry cycle. The agitators will not discolor clothing, and are safe to be used with bleach.

The sizes can vary from up to several inches or more in diameter. The term "approximately" can be +/−10% of the amount referenced. Additionally, preferred amounts and ranges can include the amounts and ranges referenced without the prefix of being approximately.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim:

1. Cleaning devices for washing machines, comprising:

a plurality of agitators each of the agitators having shapes formed from molded materials that do not release any chemicals, each of the agitators consisting of:

two generally straight elongated prongs in a cross pattern perpendicular to one another and each of the prongs being perpendicular with one another, each of the prongs having enlarged bulbous ends, the two generally straight elongated prongs being in a first plane; and a single elongated post extending an equal distance from each side of a center of the cross pattern of the prongs, the single elongated post having a diameter that tapers down in opposite directions from the center of the cross pattern outward to round tip ends, the single elongated post being in a second plane that is perpendicular to the first plane of the two generally straight elongated prongs, wherein the agitators are for further breaking up detergent and cleaning materials used in washing machines having loads of laundry while the washing machines are being used during at least one cycle.

2. The cleaning devices of claim 1, wherein each of the agitator shapes are formed from silicone.

3. The cleaning devices of claim 1, wherein the at least one cycle includes:

a cleaning cycle.

4. The cleaning devices of claim 1, wherein the at least one cycle includes:

a rinse cycle.

5. The cleaning devices of claim 1, wherein the at least one cycle includes:

a cleaning cycle and a rinse cycle.

6. The cleaning devices of claim 1, further comprising:

the plurality of the agitators consisting of three agitators; and a package for holding the three agitators.

7. A method of enhancing cleaning of laundry in washing machines, comprising the steps of:

providing a plurality of agitators, each formed from molded material that do not release chemicals;

providing each of the agitators consist of two generally straight elongated prongs in a cross pattern perpendicular to one another, each of the prongs having enlarged bulbous ends, the generally straight elongated prongs being in a first plane, and a single elongated post extending an equal distance from each side of a center of the cross pattern of the prongs, the single elongated post having a diameter that tapers down from the center of the cross pattern outward to round tip ends;

inserting the plurality of agitators into a washing machine basket having a load of laundry having detergent and cleaning materials;

running the washing machine basket through at least one cycle;

breaking up the detergent and the cleaning materials with the agitators; and removing the agitators from the load of laundry.

8. The method of claim 7, wherein the at least one cycle includes a cleaning cycle.

9. The method of claim 7, wherein the at least one cycle includes a rinse cycle.

10. The method of claim 7, wherein the at least one cycle includes a cleaning and rinse cycle.

11. The method of claim 7, wherein the removing cycle further includes the step of:

removing the agitators before placing the cleaned laundry into a dryer.

* * * * *